US006675860B2

(12) United States Patent
Steele

(10) Patent No.: US 6,675,860 B2
(45) Date of Patent: Jan. 13, 2004

(54) WINDOW AND DOOR TREATMENT COMPLEX

(76) Inventor: Doris M. Steele, 100 Country Club Dr. East, South Burlington, VT (US) 05403

( * ) Notice: Subject to any disclaimer, the term of this patent is extended or adjusted under 35 U.S.C. 154(b) by 79 days.

(21) Appl. No.: 10/078,577

(22) Filed: Feb. 20, 2002

(65) Prior Publication Data

US 2003/0154670 A1 Aug. 21, 2003

(51) Int. Cl.[7] ..... E06B 3/30

(52) U.S. Cl. ..... 160/90; 160/368.1; 160/237; 52/202; 52/203; 52/DIG. 13; 52/311.1

(58) Field of Search ..... 52/202, 203, DIG. 13, 52/311.1; 160/90, 368.1, 354, 237, 180

(56) References Cited

U.S. PATENT DOCUMENTS

| | | | | |
|---|---|---|---|---|
| 2,514,316 A | * | 7/1950 | Dobrin | |
| 3,251,399 A | * | 5/1966 | Grossman | |
| 3,668,808 A | | 6/1972 | Perina | |
| 4,068,428 A | * | 1/1978 | Peterson | 52/202 |
| 4,249,589 A | * | 2/1981 | Loeb | 160/354 X |
| 4,271,566 A | * | 6/1981 | Perina | 160/354 X |
| 4,272,934 A | * | 6/1981 | Cowden et al. | 52/202 |
| 4,513,548 A | * | 4/1985 | Parker | 52/202 |
| 4,562,675 A | * | 1/1986 | Baigas et al. | 52/202 |
| 4,616,456 A | * | 10/1986 | Parker | 52/202 |
| 4,794,281 A | | 12/1988 | Onodera et al. | |
| 4,867,222 A | | 9/1989 | Roman et al. | |
| 4,972,896 A | * | 11/1990 | Roberts | 160/354 |
| 5,010,944 A | | 4/1991 | Bussert | |
| 5,172,504 A | * | 12/1992 | De Maat et al. | 52/DIG. 13 X |
| 5,368,085 A | | 11/1994 | Ruparelia | |
| 5,547,010 A | | 8/1996 | Stuart | |
| 5,597,028 A | | 1/1997 | Rolf et al. | |
| 5,669,191 A | * | 9/1997 | Weaver | 52/202 |
| 5,915,442 A | | 6/1999 | Prosch | |
| 5,960,847 A | * | 10/1999 | Crider et al. | 160/121.1 |
| 5,996,674 A | | 12/1999 | Gatewood | |
| 6,026,886 A | | 2/2000 | Diamond-Martinez | |

FOREIGN PATENT DOCUMENTS

| | | | |
|---|---|---|---|
| WO | 84/04559 | * 11/1984 | E06B/9/08 |

* cited by examiner

*Primary Examiner*—Robert Canfield
(74) *Attorney, Agent, or Firm*—John J. Welch, Jr., Esq.

(57) ABSTRACT

A window and door treatment complex characterized by base pairs of hook and fastener strapping units removably affixed to a window to which units there is removably affixed via hook and fastener strapping affixed to a rear side of a first coverlet, a first coverlet made up of insulating fabric about which there is sewn an outer fabric and into which insulating fabric and outer fabric a through hole has been cut and affixed to near the top border and near the bottom border of the frontal side of which first coverlet there is hook and fastener material removably affixable to hook and fastener material attached to a rear side of a second coverlet made up of an insulating material about which there is sewn an outer fabric, the front side of which, near lateral borders thereof and near top and bottom borders thereof, is characterized by the presence of hook and fastener material.

2 Claims, 7 Drawing Sheets

WINDOW AND DOOR TREATMENT COMPLEX

CROSS-REFERENCES TO PRIOR OR PARENT APPLICATIONS

Figure 1:
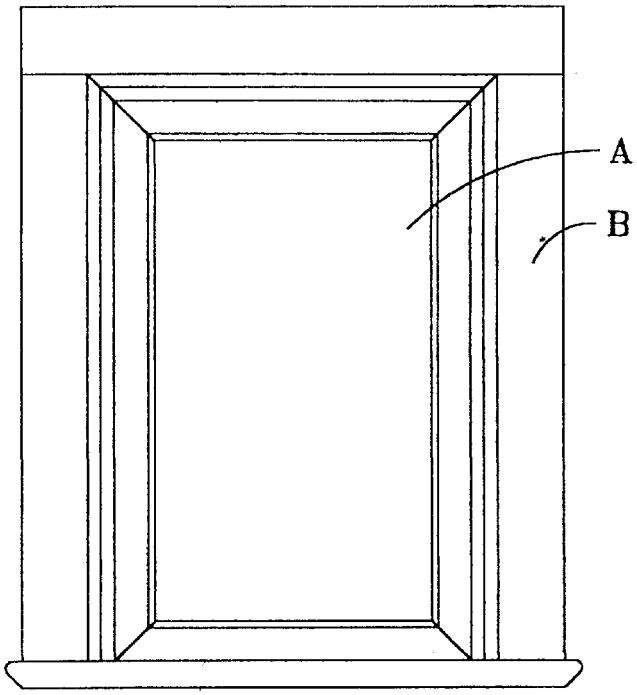
FIG. 1 (Prior Art)

There are no prior or parent applications to which the instant invention relates.

FEDERALLY SPONSORED RESEARCH AND DEVELOPMENT

The instant invention has not been the subject of any federally sponsored research or development.

BACKGROUND OF THE INVENTION

1. Field of the Invention

The instant invention relates to those devices meant to serve as insulations on windows or doors as against outside heat or cold or light.

2. Related Art

Those devices referenced in the Information Disclosure Statement submitted herewith relate to but do not anticipate the instant invention.

A SUMMARY OF THE INVENTION

1. A Brief Description of the Instant Invention

The invention, to begin with, consists of a first base pair of hook and fastener strapping units that are removably attached up and down-wise to the outermost perimeter of the glass windowpane portion of a window unit or a door unit, and a second base pair of hook and fastener strapping units that are removably attached crosswise to the top side and bottom side respectively of the outermost perimeter of the glass windowpane portion of the window unit or door unit. Removably affixable on the rear side thereof to these two pairs of strapping units via two corresponding first pairs of hook and fastener units attached to the rear side thereof, is a piece of fabric sewn about insulative material known as a first coverlet into which there is decorously cut a rectangular or circular or ovalesque shaped through hole through which, at least, a portion of a window pane can be visualized. Sewable to the perimeter of this hole is a decorous porous lace-like fabric for aesthetic purposes. Bordering the frontal side of the first coverlet is second hook and fastener strapping material affixed crosswise thereto. Removably affixable from the frontal side of the first coverlet on a rear side thereof via third hook and fastener material affixed to the rear side thereof is a second piece of fabric sewn about insulative material and entitled a second coverlet which attaches via such third hook and fastener material to the second hook and fastener material affixed to the frontal side of the first coverlet. Fourth hook and fastener material affixed to a frontal side of the second coverlet allows it to be rolled up and looped up onto itself 2. Objects of the Invention The invention functions to insulate the inside areas of a residential dwelling or commercial building from exterior heat, cold or light on overtly hot or cold or bright days by way of decorously covering windows and/or doors leading to the exterior of such dwelling or such building. But, unlike other similar devices, the instant invention can be easily installed without the use of tools. Moreover, there is no need for cumbersome curtain rods or brackets for purposes of holding the instant invention in place. There are also no pulleys, beads or chains involved with the invention nor are there any screws, separate frames, knobs or bolts. The invention is thus a ready alternative to ponderous and difficult to install draperies on windows or doors. There is no need for zipper openings for ventilation since the fabric itself breathes. The invention is moreover amenable to being made beautiful as well as being functional. Also, all components of the invention are readily removable, separable, and whereas they are made up of essentially fabric material that is washable or dry cleanable, they are easy to store. Simply roll them up together and put them away until needed again.

A DESCRIPTION OF THE DRAWINGS

1. FIG. 1 is a frontal plan view of a window and window casing.

Figure 2:
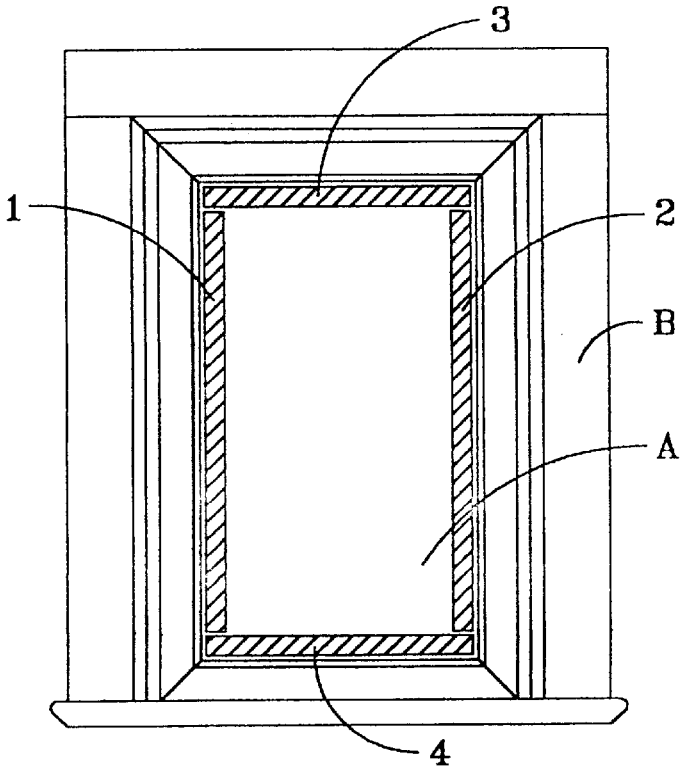

2. FIG. 2 shows two base pairs of hook and fastener strapping units affixed to the window casing shown in FIG. 1.

Figure 3:
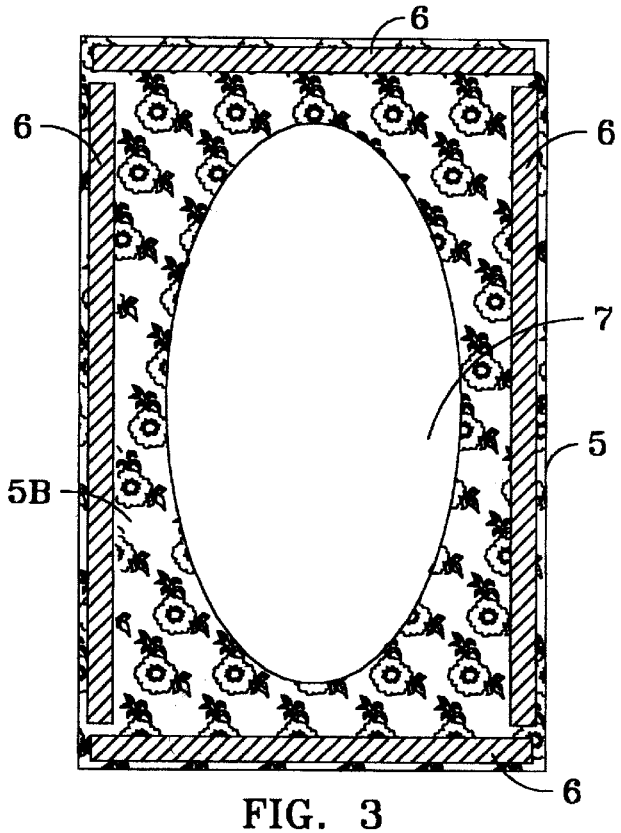

3. FIG. 3 is a rear plan view of the first coverlet of the invention absent decorous material sewn to the perimeter of the hole in the first coverlet of the invention.

Figure 4:
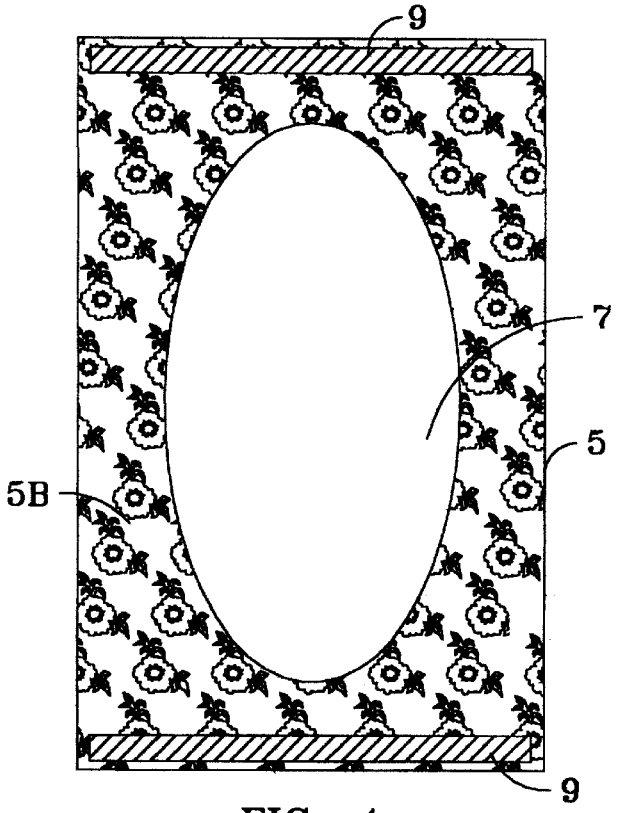

4. FIG. 4 is a frontal plan view of the first coverlet of the invention absent decorous material sewn to the perimeter of the hole in the first coverlet of the invention.

Figure 5:
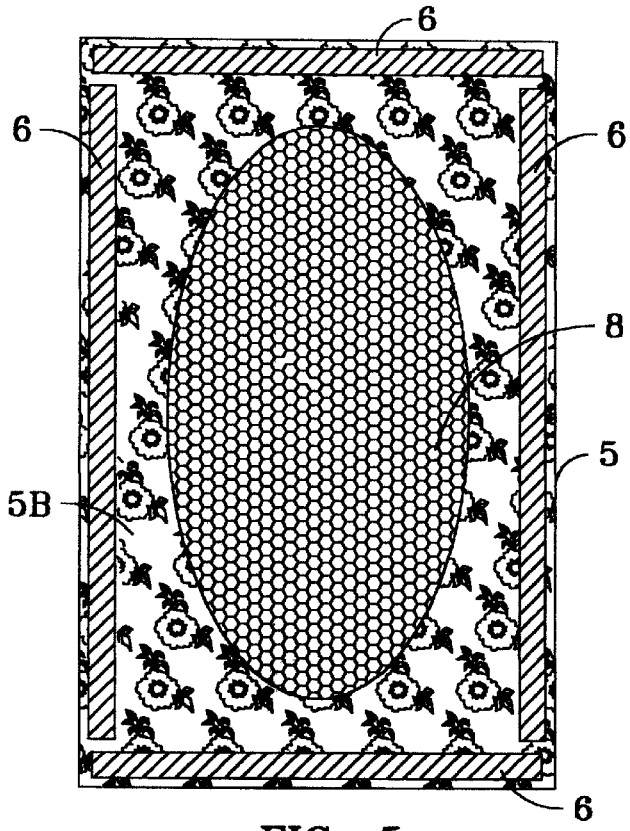

5. FIG. 5 evidences decorous material sewn to the perimeter of the hole in the first coverlet of the invention.

Figure 6:
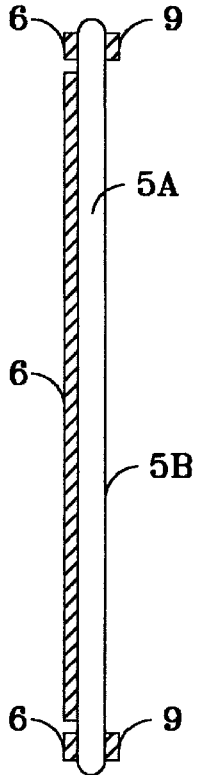

6. FIG. 6 is a lateral plan view of the first coverlet of the invention.

Figure 7:
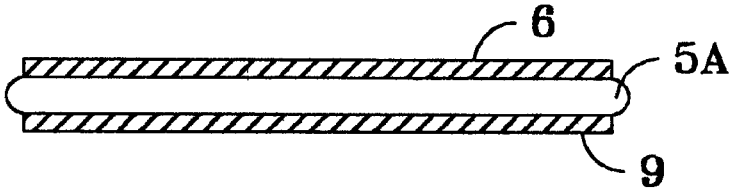

7. FIG. 7 is a top plan view of the first coverlet of the invention.

Figure 8:
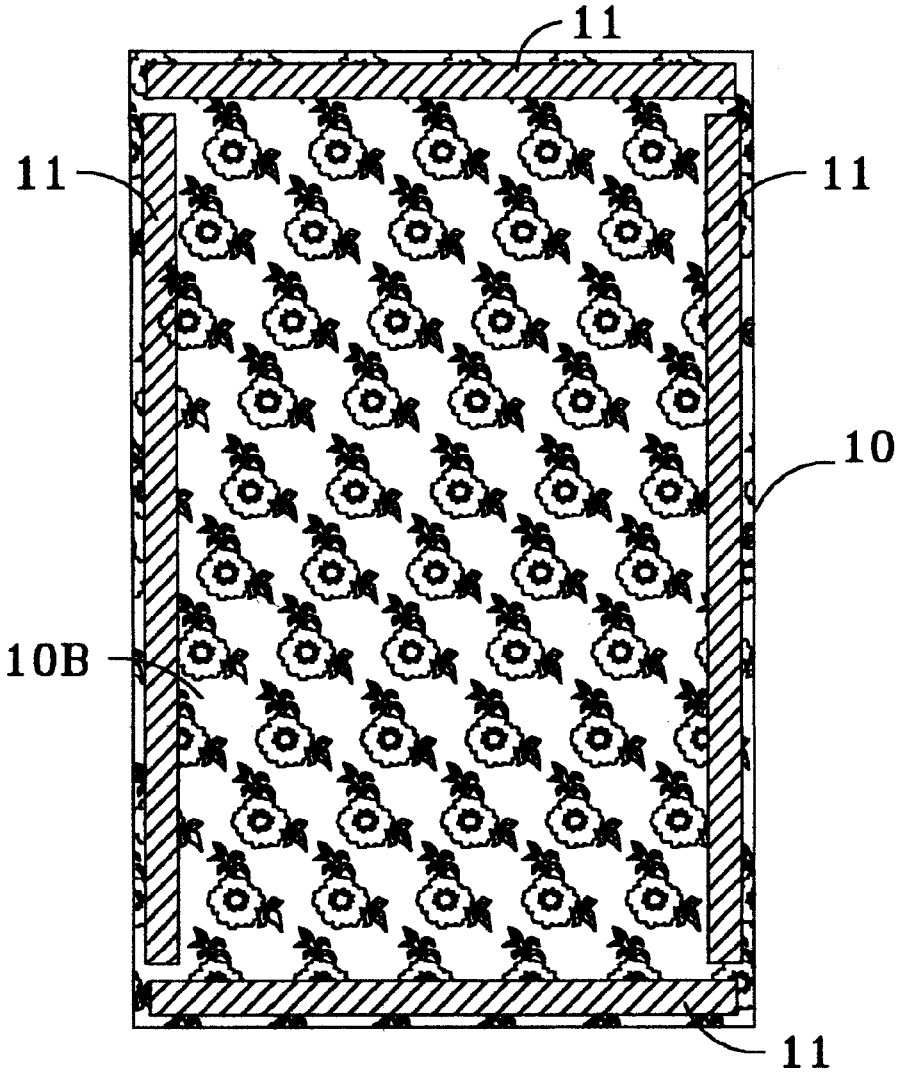

8. FIG. 8 is a rear plan view of the second coverlet of the invention.

Figure 9:
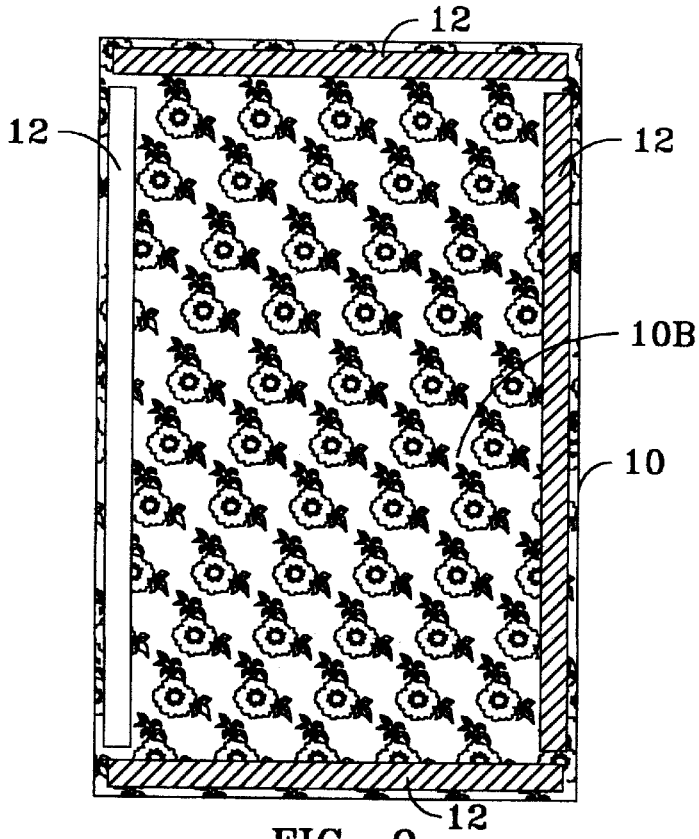

9. FIG. 9 is a frontal plan view of the second coverlet of the invention.

Figure 10:
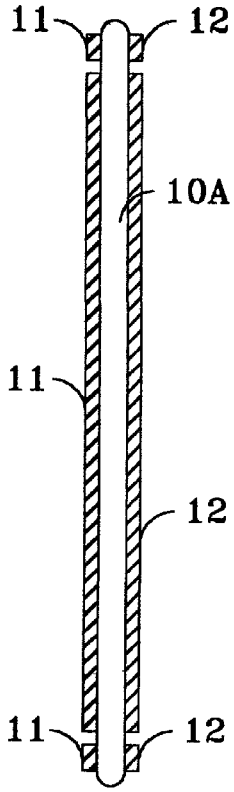

10. FIG. 10 is a lateral plan view of the second coverlet of the invention.

Figure 11:
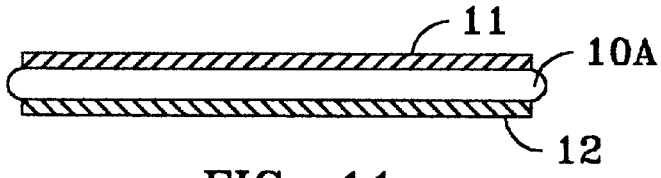

11. FIG. 11 is a top plan view of the second coverlet of the invention.

Figure 12:
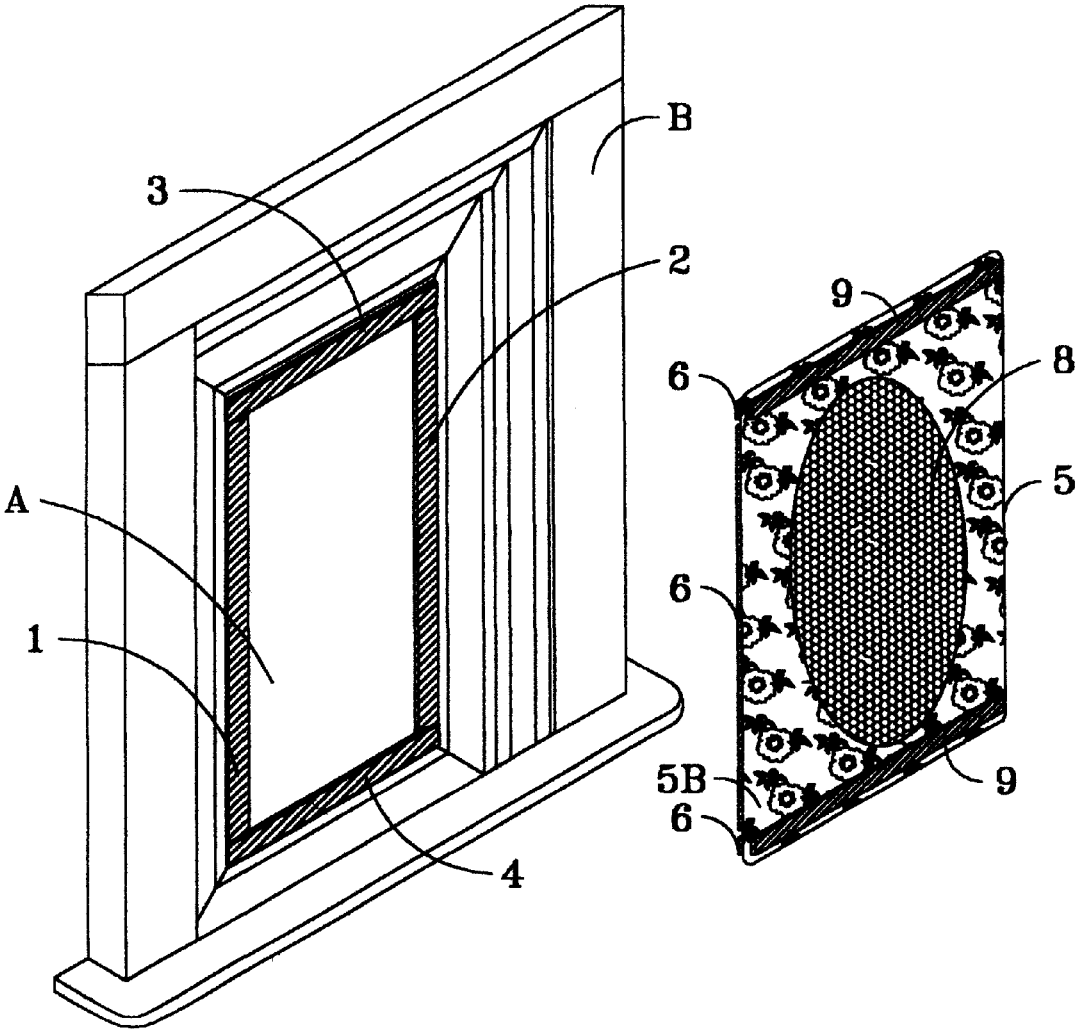

12. FIG. 12 shows the first coverlet in apposition to the base pairs of hook and fastener strapping units shown in FIG. 2.

Figure 13:
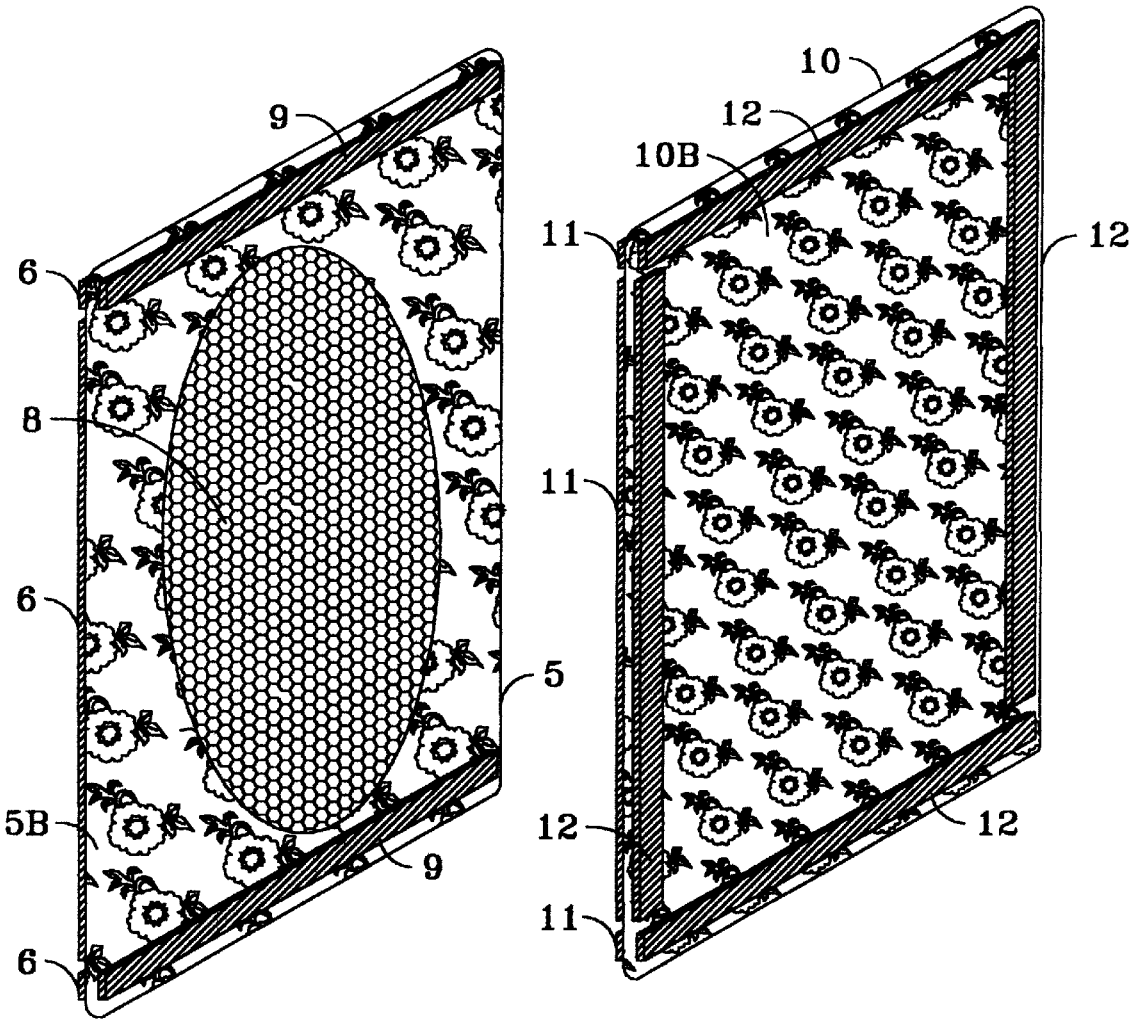

13. FIG. 13 shows the second coverlet in apposition to the anterior side of the first coverlet.

A DESCRIPTION OF THE PREFERRED EMBODIMENT

As shown in FIG. 2 removably affixed to a window A circumscribed by window casing B shown in FIG. 1 is a first base pair of hook and fastener strapping units 1 and 2 of the invention with adhesive material on a back side extending up and down the sides of window A. A second base pair of similar hook and fastener strapping units 3 and 4 of the invention extend removably affixed crosswise on window A as therein shown. Affixed to near the top, first lateral, second lateral and bottom borders of rear side of first coverlet 5 of the invention as seen in FIG. 3 is first hook and fastener strapping material 6 that enables first coverlet 5 to thereby be removably attached to base strapping units 1, 2, 3 and 4 as can be appreciated with resort to FIG. 12. A through hole 7 that can be shaped circularly or rectangularly or even ovalesque or any other shape is shown cut into first coverlet 5 as seen in FIG. 4. Hole 7 allows into a room within a dwelling or commercial building, light or heat or coolness from outside thereof. First coverlet 5 is made up of a first coverlet insulating fabric material 5A such as THINSULATE insulating fabric material about which there is sewn a first coverlet outer fabric 5B as seen in FIGS. 3 and 4. As seen in FIG. 5, a decorous lace-like material 8 can be sewn via seam means such as thread to the perimeter of through hole 7 once first coverlet outer fabric 5B is sewn about the perimeter so as to encase first coverlet insulating fabric 5A into which through hole 7 would have also been cut. Attached to near top and bottom borders of the frontal side of first coverlet 5 is second hook and fastener material 9 as seen in FIG. 4. FIGS. 6 and 7 serve to illustrate that first coverlet 5 has not insignificant body and thickness. First coverlet outer fabric 5B is moreover amenable to being decorously designed in order to appeal to any given owner's aesthetic preferences. FIG. 8 and FIG. 13 evidence how second coverlet 10 of the invention via third hook and fastener material 11 attached to near the top border, near the bottom border and near each lateral border of the rear side thereof, is removably affixable to the frontal side of first coverlet 5 by way of affixation of third hook and fastener material 11 to second hook and fastener material 9. Second coverlet 10 is likewise made up of a second coverlet insulating fabric material 10A such as THINSULATE insulating fabric material about which there is sewn a second coverlet outer fabric 10B as seen in FIGS. 8 and 9. FIGS. 10 and 11 serve to evidence that second coverlet 10 likewise has not insignificant body and thickness. FIG. 9 also serves to illustrate how second coverlet outer fabric 10B can serve to respond to an owner's aesthetic preferences as well. Second coverlet 10 serves to block out heat or light or coolness that passes from outside to inside a dwelling or building via hole 7 when second coverlet 10 is not attached to first coverlet 5 as depicted above. Fourth hook and fastener material 12 affixed to near the top border, near the bottom border and near each lateral border of the frontal side of second coverlet 10 in conjunction with third hook and fastener material 11 permits second coverlet 10 to be looped or rolled up upon itself. As previously noted, the invention can be fitted to windows in doors leading into the walling of a building as well as directly onto the windows within the walling itself of that building.

In conclusion, once again, for the reasons cited above the instant invention is indeed new, useful and unique.

What is claimed is:

1. A window and door treatment complex, comprising:

a. each of a first base pair of hook and fastener strapping units removably attached up and down-wise to a window circumscribed by window casing within walling of a building or within a door leading into or within said walling of said building;

b. each of a second base pair of hook and fastener strapping units removably attached crosswise to said window;

c. a first coverlet made up of a first coverlet insulating fabric about which there is sewn a first coverlet outer fabric;

d. a through hole cut into said first coverlet insulating fabric and said first coverlet outer fabric;

e. seam means sewn about a perimeter of said through hole serving to hold said first coverlet insulating fabric within said first coverlet outer fabric;

f. first hook and fastener material affixed to near a top border, near a first lateral border, near a bottom border and near a second lateral border of a rear side of said first coverlet;

g. said first hook and fastener material being removably attachable to said first base pair of hook and fastener strapping units and said second base pair of hook and fastener strapping units;

h. second hook and fastener material affixed to near a top border and near a bottom border of a frontal side of said first coverlet;

i. a second coverlet made up of a second coverlet insulating fabric about which there is sewn a second coverlet outer fabric;

j. third hook and fastener material affixed to near a top border near a first lateral border near a bottom border and near a second lateral border of a rear side of said second coverlet;

k. said third hook and fastener material near said top border and near said bottom border of said rear side of said second coverlet being removably attachable to said second hook and fastener material, and;

l. fourth hook and fastener material affixed to near a top border, near a bottom border and near each one of two lateral borders of a front side of said second coverlet.

2. A window and door treatment complex, comprising:

a. each of a first base pair of hook and fastener strapping units removably attached up and down-wise to a window circumscribed by window casing within walling of a building or within a door leading into or within said walling of said building;

b. each of a second base pair of hook and fastener strapping units removably attached crosswise to said window;

c. a first coverlet made up of a first coverlet insulating fabric about which there is sewn a first coverlet outer fabric;

d. a through hole cut into said first coverlet insulating fabric and said first coverlet outer fabric;

e. seam means sewn about a perimeter of said through hole serving to hold said first coverlet insulating fabric within said first coverlet outer fabric;

f. first hook and fastener material affixed to near a top border, near a first lateral border, near a bottom border and near a second lateral border of a rear side of said first coverlet;

g. said first hook and fastener material being removably attachable to said first base pair of hook and fastener strapping units and said second base pair of hook and fastener strapping units;

h. second hook and fastener material affixed to near a top border and near a bottom border of a frontal side of said first coverlet;

i. a second coverlet made up of a second coverlet insulating fabric about which there is sewn a second coverlet outer fabric;

j. third hook and fastener material affixed to near a top border, near a first lateral border, near a bottom border and near a second lateral border of a rear side of said second coverlet;

k. said third hook and fastener material near said top border and near said bottom border of said rear side of said second coverlet being removably attachable to said second hook and fastener material;

l. fourth hook and fastener material affixed to near a top border, near a bottom border and near each of two lateral borders of a front side of said second coverlet, and;

m. a fabric material sewn to all of said perimeter of said through hole.

* * * * *